US007823329B2

(12) United States Patent
Stahn et al.

(10) Patent No.: US 7,823,329 B2
(45) Date of Patent: Nov. 2, 2010

(54) HOUSING FOR RECEIVING A CABLE DRUM

(75) Inventors: Armin Stahn, Kueps (DE); Gerhard Schust, Weidhausen (DE)

(73) Assignee: Brose Fahrzeugteile GmbH & Co KG, Coburg, Coburg (DE)

( * ) Notice: Subject to any disclaimer, the term of this patent is extended or adjusted under 35 U.S.C. 154(b) by 1028 days.

(21) Appl. No.: 10/589,059

(22) PCT Filed: Jan. 28, 2005

(86) PCT No.: PCT/DE2005/000159

§ 371 (c)(1),
(2), (4) Date: Aug. 11, 2006

(87) PCT Pub. No.: WO2005/078221

PCT Pub. Date: Aug. 25, 2005

(65) Prior Publication Data

US 2007/0175098 A1 Aug. 2, 2007

(30) Foreign Application Priority Data

Feb. 12, 2004 (DE) ..... 10 2004 007 924
Mar. 19, 2004 (DE) ..... 10 2004 014 424

(51) Int. Cl.
*E05F 11/48* (2006.01)

(52) U.S. Cl. ..... 49/352

(58) Field of Classification Search ..... 49/348, 49/349, 352; 74/413; 242/615, 615.4, 548, 242/346

See application file for complete search history.

(56) References Cited

U.S. PATENT DOCUMENTS 5,511,443 A * 4/1996 Munekhoff ..... 74/505
6,305,129 B1 * 10/2001 Eckhardt et al. ..... 49/502
6,574,922 B2 * 6/2003 Velthaus et al. ..... 49/352
7,350,334 B2 * 4/2008 Smith ..... 49/352
2007/0209283 A1 * 9/2007 Ostrowski et al. ..... 49/360
2009/0078505 A1 * 3/2009 Casebolt et al. ..... 182/231

FOREIGN PATENT DOCUMENTS

DE 40 21 011 A1 1/1992

(Continued)

OTHER PUBLICATIONS

English translation of International Preliminary Report on Patentability dated Oct. 4, 2006 for corersponding PCT application No. PCT/DE2005/000159.

(Continued)

*Primary Examiner*—Jerry Redman
(74) *Attorney, Agent, or Firm*—Christie, Parker & Hale, LLP

(57) ABSTRACT

A housing for receiving a cable drum of an adjustment device for a motor vehicle includes a bearing point for rotatably mounting a cable drum, at least one wall encompassing the cable drum along the peripheral surface thereof when the cable drum is mounted in the housing, and a securing element arranged in a region of the wall of the housing and serving to secure a tractive device extending along the peripheral surface of a cable drum. The securing element is elastically configured and may be moved by deformation in the radial direction in relation to the bearing point.

29 Claims, 6 Drawing Sheets

FOREIGN PATENT DOCUMENTS

| | | | |
|---|---|---|---|
| DE | 197 41 691 | C2 | 7/1998 |
| DE | 197 55 899 | C2 | 6/1999 |
| DE | 198 12 875 | C1 | 6/1999 |
| EP | 1 302 617 | A1 | 4/2003 |
| JP | 3-228987 | | 10/1991 |
| JP | 5-280247 | | 10/1993 |
| JP | 8-128258 | | 5/1996 |
| JP | 2000-110437 | | 4/2000 |

OTHER PUBLICATIONS

International Search Report, dated Jul. 4, 2005, corresponding to PCT/DE2005/000159.

English translation of Office action dated Nov. 17, 2009 for Japanese Patent Application No. 2006-552455, 6 sheets.

* cited by examiner

HOUSING FOR RECEIVING A CABLE DRUM

CROSS-REFERENCE TO A RELATED APPLICATION

This application is a National Phase Patent Application of International Patent Application Number PCT/DE2005/000159, filed on Jan. 28, 2005, which claims priority of German Patent Application Number 10 2004 007 924.2, filed on Feb. 12, 2004 and German Patent Application Number 2004 014 424.9, filed on Mar. 19, 2004.

BACKGROUND

The invention relates to a housing for receiving a cable drum of an adjustment device for a motor vehicle.

Such a housing comprises a bearing point for rotatably mounting the cable drum; a wall (optionally a multi-part wall) which encompasses the cable drum along the peripheral surface thereof, when the cable drum (at the bearing point) is mounted in the housing; and a securing element which is arranged in the region of the wall of the housing, in particular projecting from the wall of the housing in the direction of the bearing point and which serves to secure a tractive means which encircles the cable drum along the peripheral surface thereof provided with guide means.

Such a housing may, for example, serve to mount the cable drum of a cable-operated window lifter which comprises a flexible tractive means for raising and lowering a window pane in a motor vehicle, which encircles a cable drum and may be moved by rotating the cable drum, such that the window pane to be adjusted—according to the rotational direction of the cable drum—is raised or lowered. To this end, the cable drum is coupled via a transmission to a drive, for example in the form of a drive motor which produces the drive torque required for rotating the cable drum.

The securing element provided on the housing, therefore, serves to hold a tractive means encircling the cable drum in the guide means (guide grooves) on the peripheral surface of the cable drum, namely to prevent the tractive means from slipping out of individual guide grooves of the cable drum when said cable drum is mounted on the bearing point of the housing provided therefor. The securing element serves, in particular, to secure the tractive means in the preassembled state of the housing and cable drum, i.e. before fitting the assembly comprising the housing and cable drum in a motor vehicle window lifter (transport securing device).

In this connection, there is the risk that when the cable drum is fitted into the housing, i.e. when the cable drum is positioned on the bearing point of the housing provided therefor, the tractive means may be forced by the action of the securing element projecting radially inwardly (compared with the remaining edge portions of the housing) from one guide groove into another (adjacent) guide groove of the cable drum, resulting in miswinding of the cable.

SUMMARY

The problem of the invention, therefore, is to improve further a housing of the aforementioned type.

Accordingly, the securing element is elastically configured is and is able to deform in the radial direction—in relation to the bearing point of the housing.

Thus, due to its elasticity the securing element may yield outwardly in the radial direction during assembly, i.e. when fitting the cable drum in the housing, whereby the securing element, acting on a tractive means encircling the cable drum, is prevented from forcing said tractive means out of one guide groove into another guide groove on the peripheral surface of the cable drum.

The securing element comprises a stop face which faces the bearing point of the housing and/or the peripheral surface of a cable drum mounted on this bearing point and which in the preassembled state of the housing and cable drum, namely before the fitting thereof in a motor vehicle window lifter, is intended to prevent the tractive means from slipping out of the peripheral surface of the cable drum, in particular during transport, by acting radially on the tractive means.

So that the securing element may be moved by elastic deformation sufficiently outwardly in the radial direction, away from the bearing point, the securing element is only connected to the wall of the housing in a partial region via a connecting portion and, moreover, spaced apart from the inner wall of the housing on its face facing away from the bearing point. In other words, on the face of the securing element facing away from the bearing point, a free space is provided into which the securing element is able to be moved radially outwardly with elastic deformation, so that the required flexibility is ensured during the assembly of the cable drum and the housing. The securing element may therefore easily be formed integrally on the housing, in particular on the (single- or multi-part) wall of the housing.

In addition to the elastic securing element, further securing regions may be provided on the wall of the housing, in particular in the form of integrally formed securing surfaces projecting radially inwardly from the wall, in order to be able to secure a tractive means reliably on a cable drum inserted into the housing, when the assembly of the corresponding window lifter is not yet concluded, namely in particular during the assembly.

The bearing point of the housing provided for mounting a cable drum may be formed by a bearing element in the form of a (concrete) bearing axis which is arranged on a bottom surface of the housing and is preferably formed integrally therewith.

According to a preferred development, the bearing point comprises a positive connection element for positively retaining a cable drum mounted on the bearing point, which, for example, may be formed by a projection projecting radially outwardly from the bearing point. Due to the elasticity of the housing in the region of the elastic securing element, the corresponding positive connection element may be configured rigidly, as the required elasticity during the creation of the positive connection between a cable drum and the housing is provided by the securing element provided in the region of the housing wall. It is, therefore, not necessary to design the positive connection between the housing and the cable drum to be elastic (for example, in the manner of a clip connection). Naturally, however, a housing configured according to the invention may also, if required, be connected by means of an elastic snap-in connection (clip connection) to a cable drum to be rotatably mounted in the housing.

The possibility opened up by the partial elasticity of the housing in the region of the housing wall thereof (due to the elasticity of the securing element), to use a rigid positive connection for the rotatable mounting of a cable drum in the housing, has the further advantage that, as an alternative to a positive connection, a rivet connection may also be used for the rotatable mounting of the cable drum in the housing (in particular, with a housing arranged on a baseplate consisting of metal with a metallic bearing point in the form of a bearing pin and/or bore) without modifications being necessary to the cable drum. In other words, one and the same cable drum may—according to the design of the bottom surface and the bearing point of a housing configured according to the invention—be connected to the corresponding housing by a positive connection (in the case of a bearing point provided with corresponding positive connection elements) or by rivets (in the case of a bearing point which may be formed for producing a rivet connection). Thus, different tools are not required for producing different cable drums for snap-in connections, on the one hand, and rivet connections, on the other hand.

The housing further comprises guide regions which serve as cable inlets and/or cable outlets for a tractive means to be conveyed toward the interior of the housing, the guide regions preferably guiding the tractive means, such that said tractive means is pretensioned radially inwardly in the direction of the bearing point of the housing and/or in the direction of the peripheral surface of a cable drum mounted in the housing. This means that, during operation of the window lifter, the radial forces acting on the tractive means do not act outwardly on the securing element but radially inwardly away from the securing element, said securing element is therefore relieved as much as possible during operation of the window lifter.

To this end, it may be provided that the guide regions define two guide channels, of which one serves as a cable inlet and the other as a cable outlet and which—viewed from the bearing point—enclose an angle of less than 180°, in particular an angle between 120° and 180°, particularly preferably an angle between 145° and 180° (for example 150° or 175°). The securing element is, in this case, preferably arranged in the region of the wall of the housing, in which the two guide channels merge with one another.

According to a further embodiment of the invention, the two guide channels—in relation to the bearing point—define an angle of more than 180°, in particular an angle between 140° and 180° (for example 150°). In this case, the elastically deformable securing element is preferably arranged on a wall region of the housing which—in relation to the bearing point—is arranged radially opposing that wall region in which the two guide channels converge.

A combination of a housing designed according to the invention with a cable drum mounted therein on the bearing point is characterized by the features of claim 25.

In this connection, a bearing element of the housing forming the bearing point preferably penetrates an associated bearing aperture (bearing bore) of the cable drum. The guide means provided on the outer peripheral surface of the cable drum for a tractive means encircling the cable drum in a defined manner are preferably formed by guide grooves (cable grooves).

When positioning the cable drum on the bearing point of the housing provided therefor, in order to prevent reliably a tractive means encircling the cable drum on its outer peripheral surface from being able to slip off the peripheral surface, the securing element in the positioning and/or insertion direction of the cable drum is of such a length that the axial portion of the cable drum encircled by the tractive means is covered by the securing element, during the entire assembly movement of the cable drum relative to the housing. The phrase, assembly path of the cable drum relative to the housing, is understood to be that part of the relative movement of the cable drum and housing when positioning the cable drum on the housing, in which the (preferably positive) connection between the cable drum and housing is created and resulting in relative movements of the cable drum and housing in the radial direction (in relation to the bearing point for the cable drum). (The relative movement between the cable drum and housing is therefore understood to be such that, for inserting the cable drum into the housing, the cable drum is optionally inserted into the stationary housing or the housing is placed over the stationary cable drum or the cable drum and housing are moved toward one another.) As a result, it is achieved that when introducing the cable drum into the housing for the rotatable mounting of the cable drum on the bearing point of the housing provided therefor, a portion of the tractive means encircling the cable drum is always completely covered in the axial direction (according to the direction of introduction of the cable drum into the housing) by the elastic securing element, in order to prevent the tractive means from slipping off the peripheral surface of the cable drum.

BRIEF DESCRIPTION OF THE DRAWINGS

Further features and advantages of the invention will become clear in the following description of exemplary embodiments, with reference to the figures, in which.

DETAILED DESCRIPTION

Figure 1A:
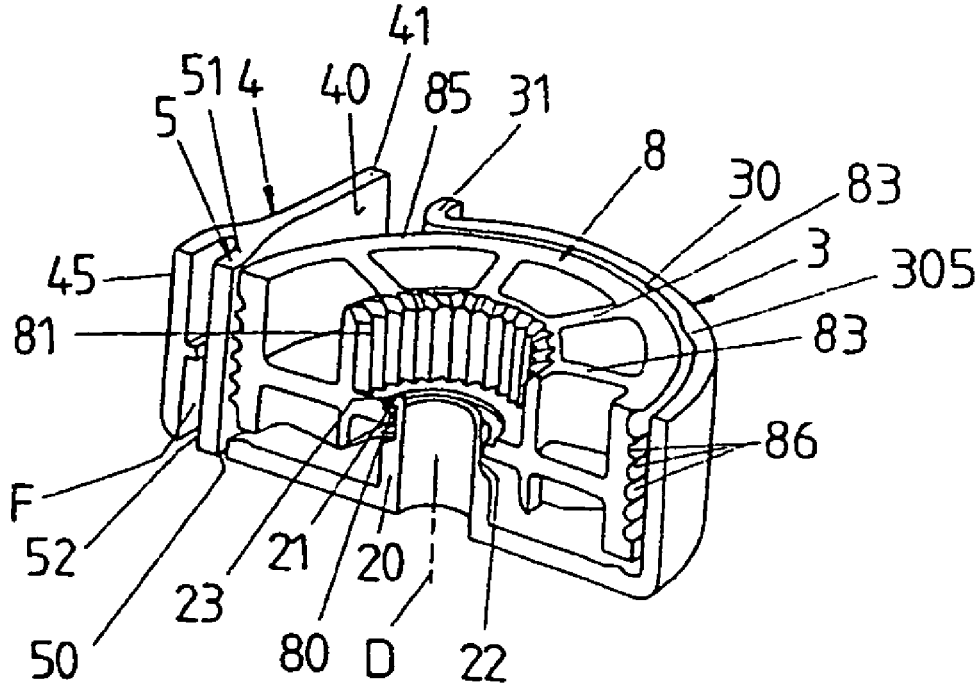
FIG. 1A is a perspective view of a portion of a cable drive housing with a cable drum mounted therein taken at section 1A of FIG. 2A.
Figure 1B:
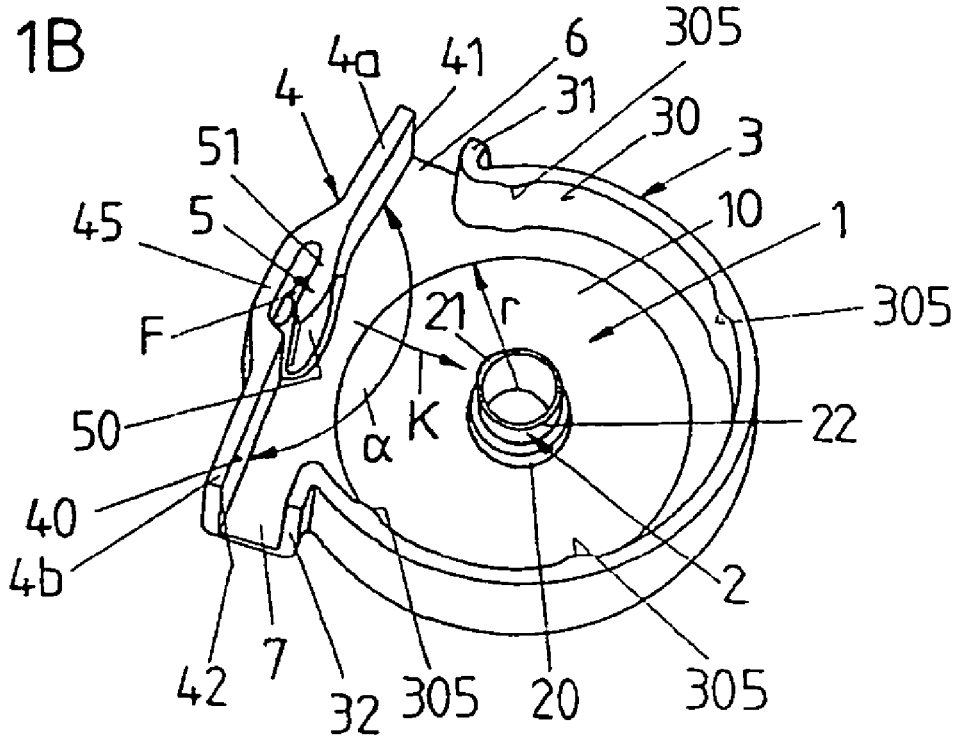
FIG. 1B is a perspective view of the cable drive housing of FIG. 1A without the cable drum.

A housing 1, 3, 4 is shown in FIG. 1A and FIG. 1B which serves as a cable drive housing for the rotatable mounting of a cable drum 8 on a bearing point 2 in a bottom surface 1 of the housing.

The cable drum 8 forms a component of an adjustment drive of a motor vehicle, for example a cable-operated window lifter, and comprises a bearing aperture 8 and, additionally, internal toothing 81 for the rotatable mounting on the bearing point 2 of the cable drive housing, via which, with a suitable transmission element provided with external toothing, a torque may be introduced into the cable drum 8 in order to generate a rotational movement of the cable drum 8 in one or other rotational direction about the rotational axis D defined by the bearing point 2.

On an outer peripheral surface which is circular in cross-section (peripheral surface 85) of the cable drum 8, guide grooves 86 (cable grooves) are configured which are extended in the peripheral direction and which serve to guide a drive means encircling the cable drum in the form of a flexible tractive means, for example a cable. The bearing portion forming the bearing aperture 80 and the portion of the cable drum 8 axially attached thereto and provided with internal toothing 81, are connected to the outer peripheral surface 85 comprising the guide grooves 86 via radially, extending webs 83.

By means of the coupling of the tractive means to the peripheral surface 85 of the cable drum 8 via the guide grooves 86 provided there, a rotational movement of the cable drum 8 produces a corresponding movement of a tractive means encircling the cable drum 8. As the tractive means, on the other hand, cooperates with a motor vehicle part to be adjusted, for example via a drive element with an adjustable window pane of a motor vehicle door, a rotational movement of the cable drum 8 is translated via the tractive means into an adjustment movement of the corresponding adjustment part, the adjustment direction thereof depending on the rotational direction of the cable drum.

The cable drum 8 is received in a cable drive housing 1, 3, 4 shown schematically in FIG. 1A and FIG. 1B and rotatably mounted there on the bearing point 2 thereof.

The cable drive housing is configured on a bottom surface 1 from which two integrally formed delimiting walls 3, 4 of the cable drive housing project, which surround a partial region of the bottom surface 1 forming the bottom region 10 of the cable drive housing.

The bearing point 2 is provided (formed) integrally on this bottom region 10 of the cable drive housing in the form of a concrete bearing axis formed by a bore. Between a base portion 20 attached directly to the bottom region 1 and a partially peripheral radially outwardly projecting projection 21 of the bore 2 said bore comprises a constriction 22 which forms the actual bearing for the bearing region in the form of a bearing aperture 80 of the cable drum 8. The cable drum 8 mounted rotatably on the constriction 22 of the bore 2 is engaged over the edge of the bearing aperture 80 thereof, on the one hand, by the base portion 20 of the bore 2 and, on the other hand, by the outwardly projecting projection 21 axially spaced therefrom, so that the cable drum 8 is positively retained—freely rotatably—with the edge of the bearing aperture 80 thereof between the base region 20 and the projection 21 of the bore 2 on the constriction 22 thereof.

As may be seen with reference to FIG. 1A, the partially peripheral projection 21 of the bore 2 in the radial direction r (see FIG. 1B) is formed with a different thickness in order to facilitate the positioning of the cable drum 8 with the bearing aperture 80 thereof on the bore 2 of the cable drive housing.

In the assembled state, the peripheral surface 85 of the cable drum 8 is enclosed by the two walls 3, 4 of the cable drive housing. Thus, the one wall 3 of the cable drive housing extends in an annular manner and/or in a circular manner in cross-section over an angle of more than 180° in front of the peripheral surface 85 of the cable drum 8 provided with the guide grooves 86 and has an inner face 30 opposing the peripheral surface 85 of the cable drum. On two end portions 31, 32 the first wall 30 of the cable drive housing for forming one respective guide channel 6, 7 is bent outwardly for a tractive means encircling the cable drum 8, in particular in the form of a cable.

The guide channels 6, 7 are formed by the aforementioned bent end portions 31, 32 of the first wall 3, together with two end portions 41, 42 spaced apart from one another of a second wall 4, which is arranged opposite the first wall 3 and which also comprises an inner face 40 facing the peripheral surface 85 of the cable drum 8. The second inner wall 4 is, however, not curved in a circular manner but instead is formed by two wall portions 4*a*, 4*b* extending toward one another at a slight acute angle and which—in relation to the bearing point 2—enclose an angle $\alpha$ of less than 180°, for example an angle $\alpha$=175°.

In the region of the second wall 4 in which the two wall portions 4*a*, 4*b* converge, the second wall 4—viewed from the bearing point 2 of the cable drive housing—is slightly offset toward the rear in a central portion 45 and is provided with an integrally formed securing element 5 via a connecting portion 51. Said securing element comprises a first surface 50 acting as a stop and/or support face facing the peripheral surface 85 of the cable drum 8, and a second surface 52 facing away from the peripheral surface 85 and instead facing the set-back (central) portion 45 of the second wall 4. A free space F extends between this second surface 52 of the securing element 5 and the set-back wall portion 45 of the second wall 4, i.e. the surface 52 of the securing element 5 facing the central wall portion 45 is spaced from that set-back wall portion 45 in the radial direction r.

The securing element 5 is located with its surface 50 facing the peripheral surface 85 of the cable drum 8 opposite that region of the bore 20 in which the partially peripheral projection 21 thereof, projecting outwardly, has the greatest extension in the radial direction r outwardly. In other words, when positioning the cable drum 8 on the bore 2 of the cable drive housing serving as a bearing point, a comparatively large outward relative movement in the radial direction r is required at this point, in order to push the cable drum 8 at a specific oblique position with its bearing aperture 80 over the projection 21, an oblique portion 23, acting as a support, being provided on the projection 21.

Such a relative movement in the radial direction r is made possible by the aforementioned elastic configuration in the radial direction r of the securing element 5, which is merely connected integrally via a connecting portion 51 in the form of a connecting web at a lateral end to the second wall 4, being also spaced apart therefrom, however, by a free space F so that the securing element 5 may be moved into the aforementioned free space F by deformation in the radial direction r. By means of this elasticity of the securing element 5, it is ensured that said securing element, during the assembly of the cable drum 8 and cable drive housing, does not act with such a force on a tractive means extending into the guide grooves 86 of the cable drum 8, that said tractive means might be forced out of the corresponding guide groove. More specifically, the elastic securing element 5 yields when the radial forces act and may be deformed outwardly in the radial direction r, in order to allow trouble-free assembly of the cable drum 8 and cable drive housing. Miswinding of the tractive means during assembly, i.e. slipping of the tractive means from one guide groove 86 into an adjacent guide groove, is consequently prevented. In addition to the elastic securing element 5 in the central region of the second wall 4, radially inwardly projecting securing regions 305 in the form of securing surfaces are provided on the inner face 30 of the first wall 3, and which serve to fix a tractive means guided in the guide grooves 86 of the cable drum 8, i.e. intended, in particular, to prevent a tractive means guided on the outer peripheral surface 85 of the cable drum 8 from slipping out of the respective guide groove 86. Thus it is to be ensured that a tractive means is not able to slip down from the cable drum 8, when during the assembly process (i.e. before the final assembly of the corresponding window lifter) the tractive means is still loose in the guide grooves 86 of the cable drum. The securing regions 305 in the form of securing surfaces are therefore preferably arranged (distributed) along the periphery of the first wall 3, such that none of the securing regions 305 radially oppose the elastic securing element 5—in relation to the bearing point 2.

In the assembled state of the cable drum 8 and the cable drive housing, as shown in FIG. 1A, the securing element 5, now relieved in the radial direction, is located in front of an associated portion of the peripheral surface 85 of the cable drum 8, so that during the mounting and transport of the assembly composed of the cable drive housing and the cable drum 8, it prevents a tractive means encircling the peripheral surface 85 of the cable drum 8 from slipping off.

When, subsequently, the assembly composed of the cable drum 8 and the cable drive housing is fitted in an adjustment device of a motor vehicle, for example a window lifter, the tractive means is no longer able to slip off the peripheral surface 85 of the cable drum 8, due to the tension which is now present on the tractive means. The securing function of the securing element 5 is no longer important under these conditions.

By means of the slightly angled extension toward one another of the two guide channels 6, 7 which serve as a cable inlet and cable outlet for a tractive means encircling the cable drum 8 on the outer peripheral surface 85 thereof, during operation of the respective adjustment device a reaction force K acts on a tractive means extending through these channels 6, 7 inwardly in the radial direction. As a result, during operation of the corresponding adjustment device the tractive means is prevented from loading the securing element 5 and/or dragging thereon.

Figure 2A:
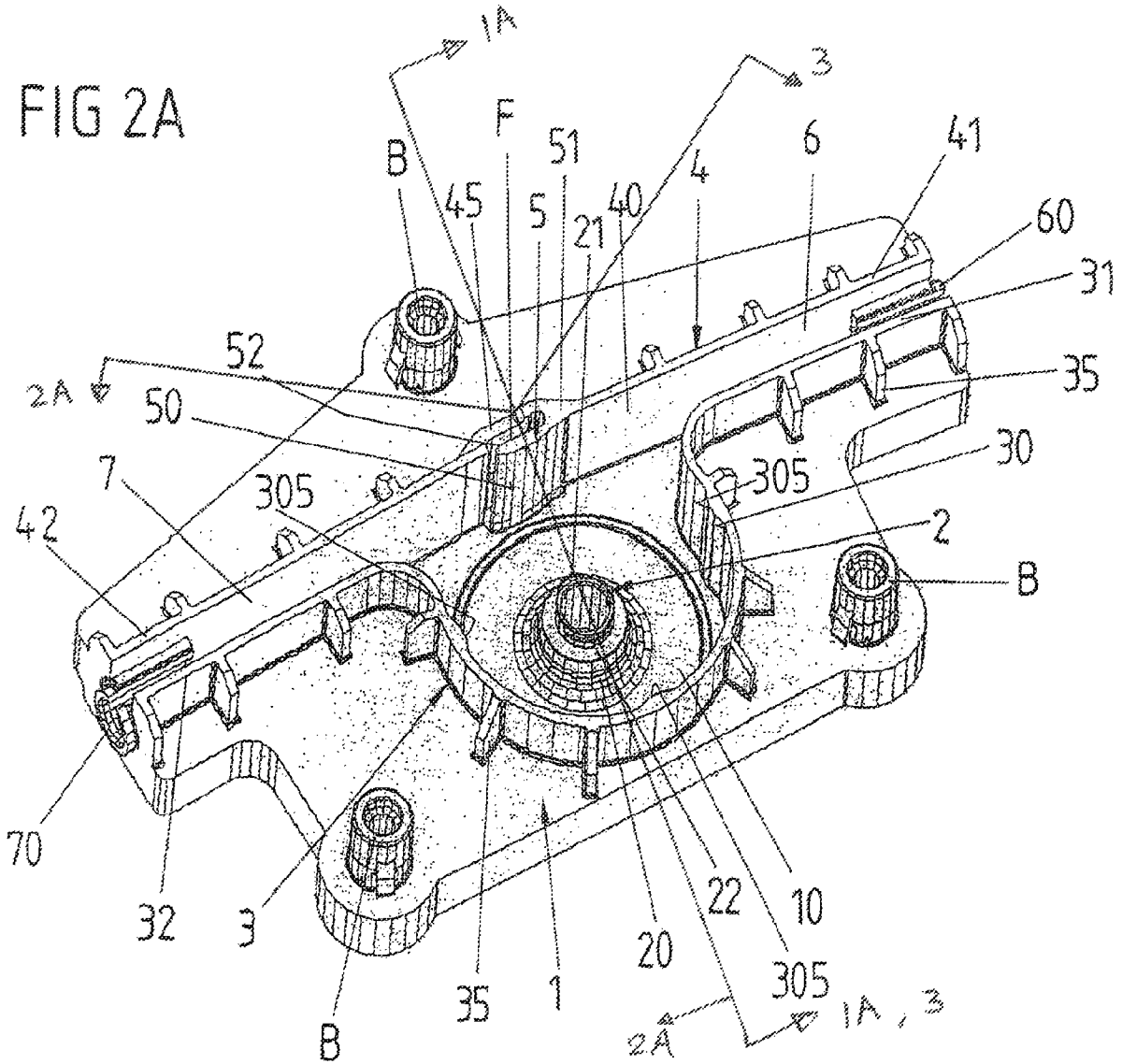
FIG. 2A is a perspective view of a development of the cable drive housing of FIG. 1B.
Figure 2B:
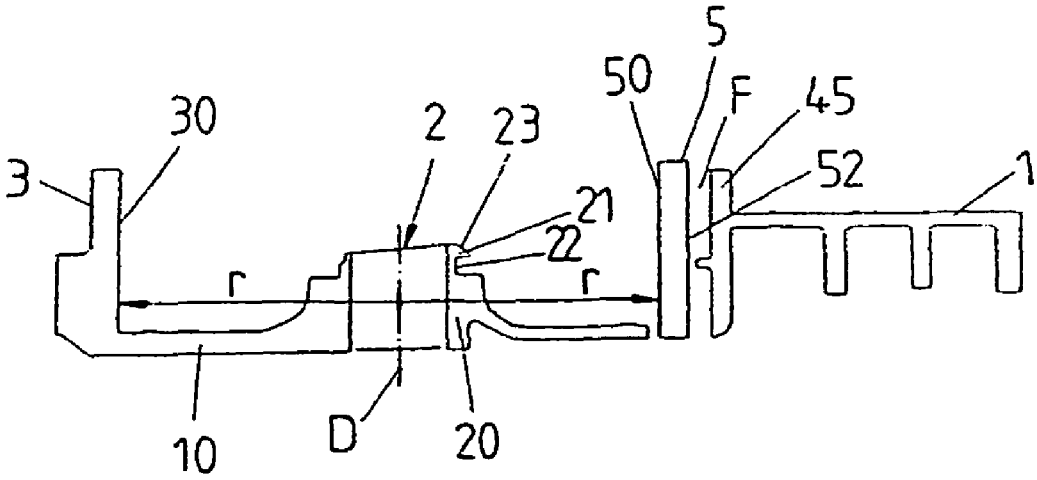
FIG. 2B is a cross-sectional view of a portion of-the cable drive housing according to FIG. 2A taken at section 2B of FIG. 2A.

A development of the cable drive housing described with reference to FIG. 1A and FIG. 1B is shown in FIG. 2A and FIG. 2B, the developed drive housing being additionally shown in FIG. 3 and FIG. 4, together with a cable drum 8 mounted therein. In, principle, the configuration of the cable drive housing and the cable drum 8 corresponds to the exemplary embodiment described with reference to FIG. 1A and FIG. 1B and, for clarification of the correspondence, identical reference numerals being used for the same assemblies. Therefore the differences between the arrangement shown in FIGS. 2A and 2B, 3 and 4 on the one hand and the exemplary embodiment shown in FIGS. 1A and 1B on the other hand are only briefly explained hereinafter. Moreover, reference is made to the above embodiments in FIGS. 1A and 1B.

On the one hand, the cable drive housing shown in FIGS. 2A, 2B, 3 and 4 differs from that shown in FIGS. 1A and 1B in the size of the baseplate defining the bottom surface 1, from which the lateral delimiting walls 3, 4 of the housing project. The extension of this bottom surface 1 is, in this case, considerably greater than the bottom region 10 of the actual housing enclosed by the delimiting walls 3, 4 and is provided with fastening points B for fastening the housing to further vehicle components, for example to a transmission unit, in particular a transmission casing. Moreover, the lateral delimiting walls 3, 4 of the housing are provided with reinforcing ribs 35 which extend from the delimiting walls 3, 4 to the bottom surface 1 of the housing baseplate.

A further difference is that the guide channels 6, 7 serving as cable inlets and cable outlets, respectively formed by end portions 31, 41; 32, 42 of the lateral delimiting walls 3, 4 of the cable drive housing, have a markedly longer length than in the case of FIGS. 1A and 1B and that at the ends of these guide channels 6, 7 guide bushes 60, 70 are respectively provided which are intended to ensure defined conveyance of a tractive means S to the respective channel 6, 7.

Moreover, with reference to FIGS. 2A and 2B it may be seen particularly clearly that the partially peripheral projection 21 on the bore 2 has a variable form in the radial direction r and that this projection 21 in a region (observed in the peripheral direction) in which it opposes the elastic securing element 50 in the radial direction r, has the greatest extension in the radial direction r.

Figure 3:
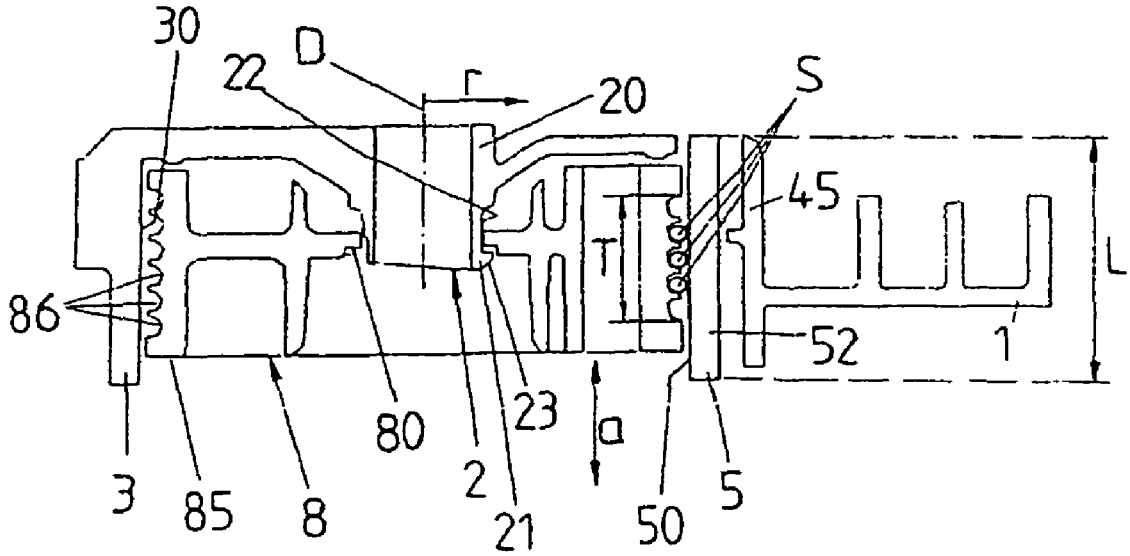
FIG. 3 is a cross-sectional view of a portion of the cable drive housing according to FIG. 2*a* during the assembly of a cable drum which is also shown in cross section and mounted in the housing taken at section 3 of FIG. 2A.
Figure 4:
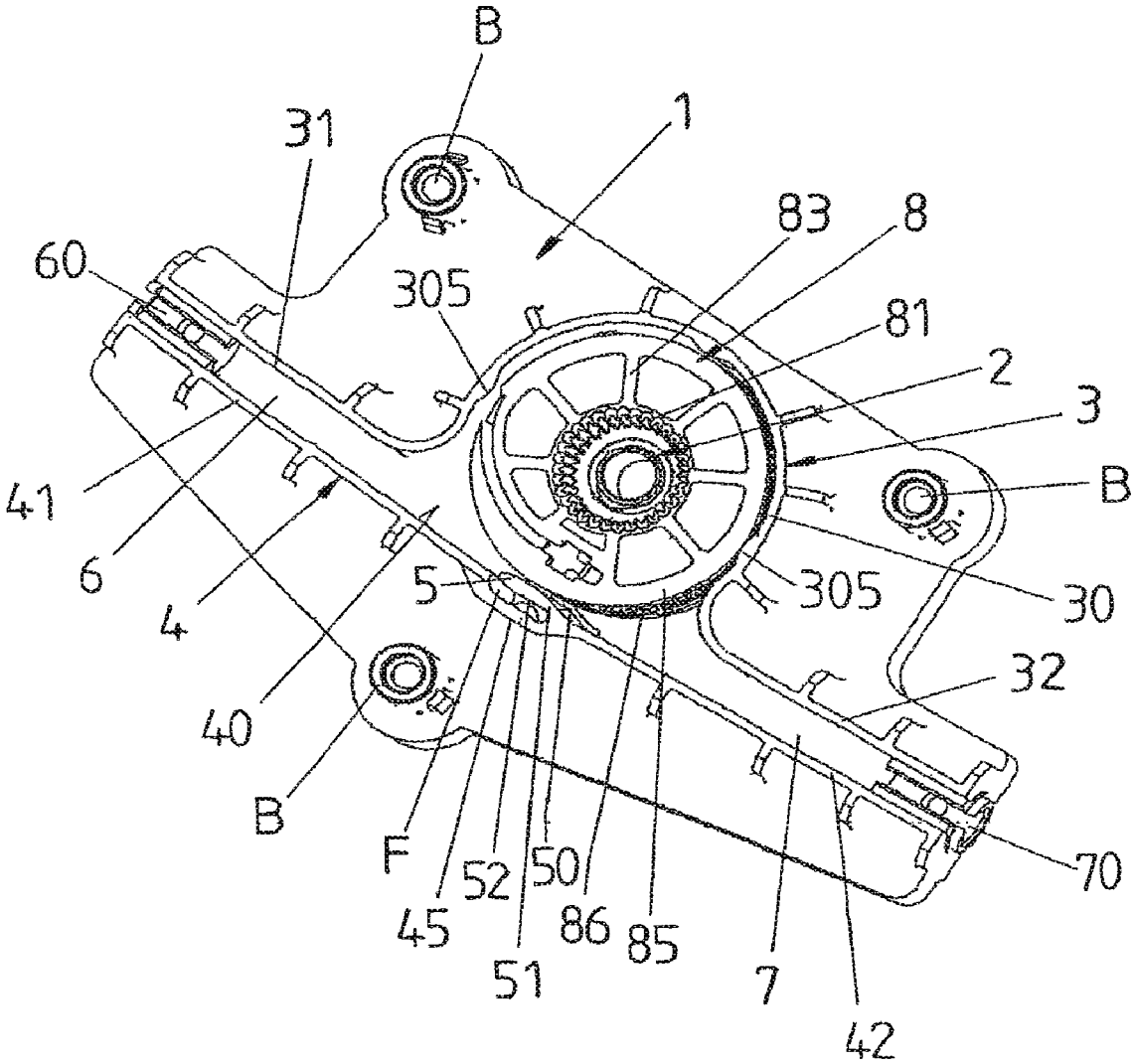
FIG. 4 is a perspective view of the cable drive housing according to FIG. 2A with a cable drum mounted rotatably therein.

It may be seen with reference to FIG. 3 that, in the axial direction a, which at the same time corresponds to the direction in which, during assembly, the cable drum 8 and the cable drive housing are joined together, the securing element 5 has a markedly greater extension (length L) than the region of the peripheral surface 85 of the cable drum 8 provided with guide grooves 86, with an axial extension T<L. As a result, it is achieved that, during assembly of the cable drum 8 and the cable drive housing, the region of the peripheral surface 85 of the cable drum 8 opposing the securing element 5 and provided with guide grooves 86, is already completely covered in the axial direction a by the securing element 5, when the edge of the bearing aperture 80 of the cable drum 8 slides over the oblique portion 23 on the projection 21 of the bore 2 serving to mount the cable drum 8 and thus carries out a movement in the radial direction r. Thus it is ensured that, when assembling the cable drum 8 and the cable drive housing, the tractive means S extending along the guide grooves 86 in the form of a cable is already covered along the entire extension T of the guide grooves 86 in the axial direction a by the securing element 5, in order to prevent parts of the tractive means S from slipping out of one of the guide grooves 86 and thus to prevent miswinding of the tractive means S.

The embodiment described above with reference to FIGS. 1A to 4 of a cable drive housing for mounting a cable drum of an adjustment device in a motor vehicle may be produced both from plastics and from metal, in particular sheet metal.

FIG. 5A once again shows a cable outlet housing of the type shown in FIGS. 1A and 1B in schematic plan view. With regard to the description of the cable outlet housing shown in FIG. 5A, reference is made to the embodiments of FIGS. 1A and 1B, for simplification the same reference numerals being used in FIG. 5A for corresponding components of the cable outlet housing as in FIGS. 1A and 1B.

Figure 5A:
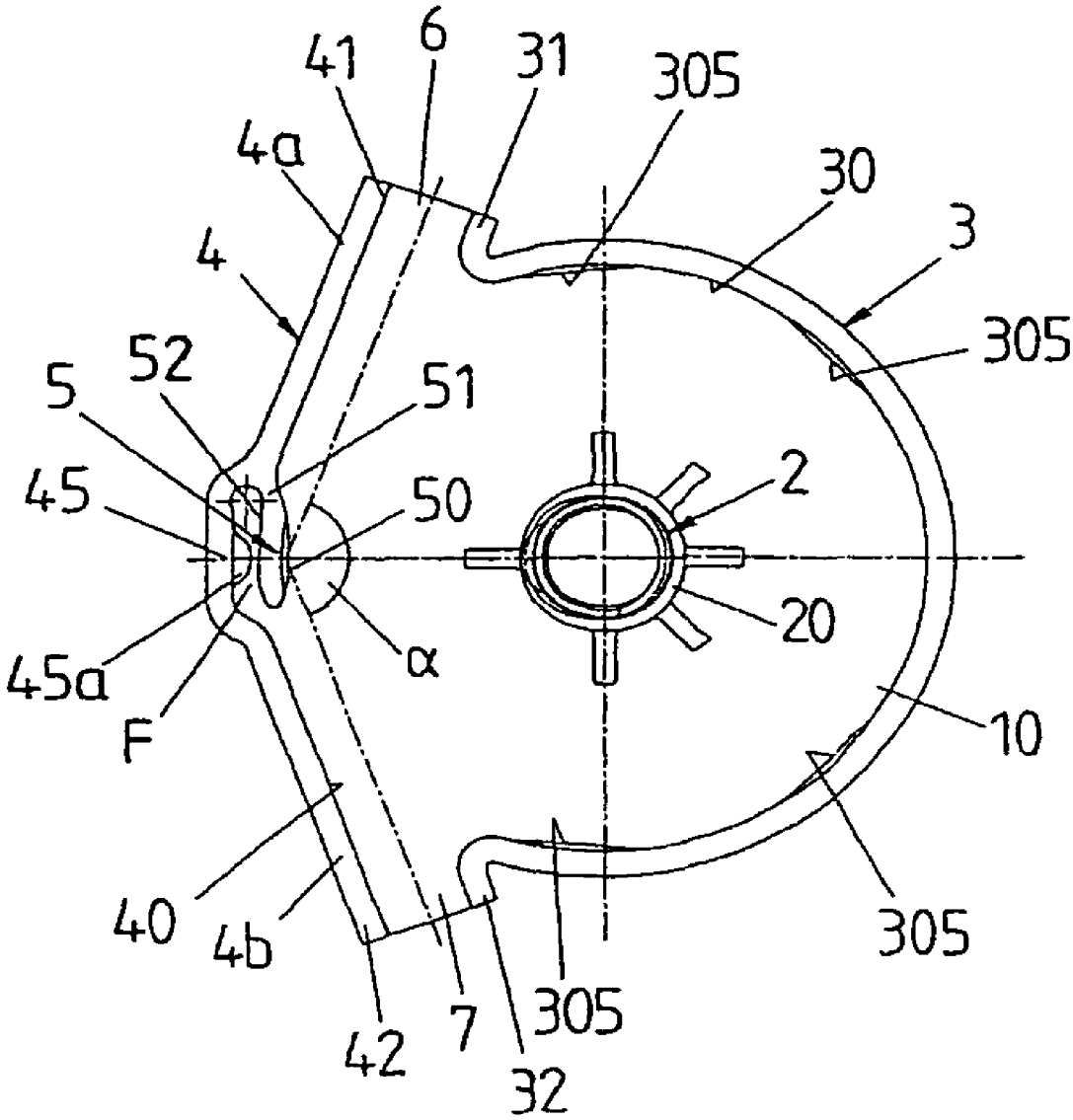
FIG. 5A is a schematic plan view of a cable drive housing according to FIG. 1B.
Figure 5B:
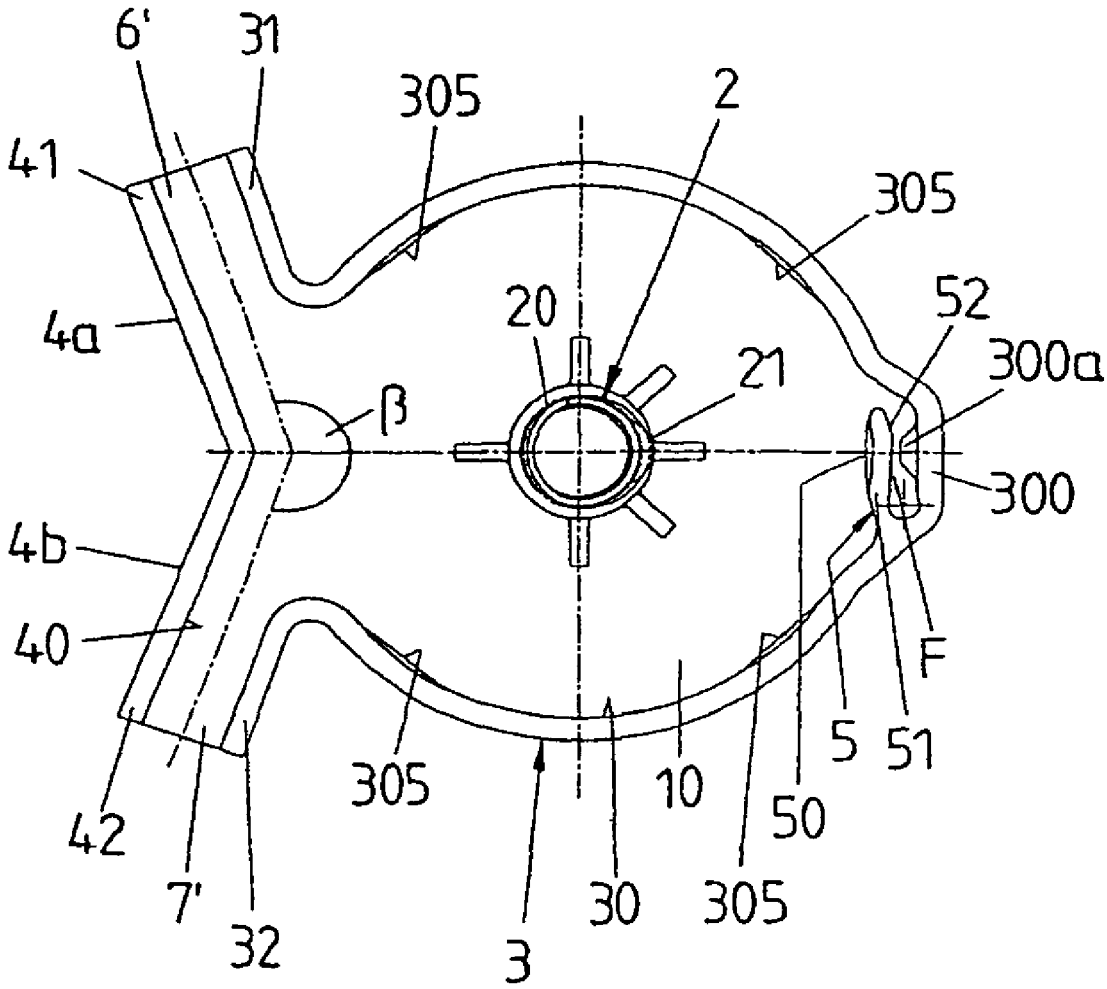
FIG. 5B is a modification of the cable drive housing of FIG. 5A in a plan view.

FIG. 5B shows a schematic representation of a modification of the cable outlet housing of FIG. 5A and thus also a modification of the housing of FIGS. 1A and 1B, a substantial difference existing therein, in that the two guide channels 6', 7'—respectively formed by angled end portions 31, 32 of the first wall 3, together with two associated end portions 41, 42 of the second wall 4—in relation to the bearing point 2, enclose an angle β of more than 180°, for example 210°. The two guide channels 6', 7' accordingly form a crossed cable outlet.

In this connection, according to a second difference from the embodiment of a cable outlet housing shown in FIGS. 1A, 1B and 5A, the elastic securing element 5 is not arranged in a central region of the second wall 4, in which the two wall portions 4*a*, 4*b* forming the second wall 4 and extending at an angle to one another, converge, but rather radially opposing the central region of the second wall portion 4—in relation to the bearing point 2—in a central region 300 of the first wall 3. The securing element 5 is, in turn, formed integrally there by means of a connecting portion 51 and, on the one hand, has a surface facing the bearing point 2 (and thus the peripheral surface of a cable drum inserted in the corresponding housing) which is used as a stop and/or support face and, on the other hand, a second surface 52 facing the set-back central portion 300 of the second wall 3. Between this second surface 52 of the securing element 5 and the set-back wall portion 300 of the first wall 3 and/or a raised portion 300*a* provided there, a free space F extends, i.e. the surface 52 of the securing element 5 facing the central wall portion 300 and/or the raised portion 300*a* there, is radially spaced from that set-back wall portion 300 and the raised portion 300*a* there. This corresponds to the distance in the radial direction r between the surface 52 of the securing element 5 facing the central wall portion 45 and/or a raised portion 45A there and that set-back wall portion 45 and/or the raised portion 45A thereof, in the embodiment shown in FIGS. 1A, 1B and 5A of a cable outlet housing and results in a corresponding technical function, see the embodiments of FIGS. 1A and 1B which refer thereto.

The partially peripheral projection 21 of the bearing point 2 formed by a bore 20 is, therefore, located opposite the elastic securing element 5 with its region of greatest extension in the radial direction r, so that the region of greatest extension of the projection 21 in the exemplary embodiment shown in FIG. 5B is arranged to be rotated by 180° relative to the exemplary embodiment shown in FIG. 5A.

As a result, both in the exemplary embodiment shown in FIG. 5A and the exemplary embodiment shown in FIG. 5B of a cable outlet housing, the further securing regions 305 projecting radially inwardly in the form of securing surfaces are respectively arranged and aligned at an angle to the reaction forces produced by the respective securing element 5 and/or by a tensioned tractive means in the region of the securing element 5 (see the reaction forces K in FIG. 1B).

The invention claimed is:

1. A housing for receiving a cable drum of an adjustment device for a motor vehicle wherein the cable drum comprises a peripheral surface with guide means for a tractive member encircling the cable drum, the housing comprising:

a bearing point for rotatably mounting the cable drum;

at least one wall encompassing the cable drum along the peripheral surface of the cable drum when said cable drum is mounted in the housing;

a securing element proximate to the wall of the housing and configured to secure the tractive member extending along the peripheral surface of the cable drum when the cable drum is mounted in the housing;

wherein the bearing point comprises a positive connection element for positively retaining the cable drum when mounted on the bearing point, the positive connection element being formed by a projection projecting radially outwardly from the bearing point;

wherein the securing element is located opposite the projection;

wherein the securing element is, elastically configured and is movable by deformation in a radial direction in relation to the bearing point; and wherein due to the elastic configuration of the securing element, the securing element yields outwardly in the radial direction when fitting the cable drum into the housing such that the cable drum is rotatably mounted on the bearing point.

2. The housing according to claim 1, wherein the securing element comprises a stop face which faces the bearing point of the housing.

3. The housing according to claim 1 or 2, wherein the securing element is outwardly movable away from the bearing point by elastic deformation in the radial direction in relation to the bearing point.

4. The housing according to claim 1, wherein the securing element is connected to the wall of the housing via a connecting portion.

5. The housing according to claim 4, wherein a side of the securing element facing away from the bearing point is spaced apart from an opposing wall portion of the wall of the housing.

6. The housing according to claim 1, wherein a free space is provided on a side of the securing element facing away from the bearing point.

7. The housing according to claim 1, wherein the securing element is formed integrally on the housing.

8. The housing according to claim 1, wherein the bearing point is formed by a fixed bearing axis.

9. The housing according to claim 1, wherein the bearing point is arranged on a bottom region of the housing.

10. The housing according to claim 1, wherein the bearing point is formed integrally on the housing.

11. The housing according to claim 1, wherein the positive connection element is configured rigidly.

12. The housing according to claim 1, wherein guide regions are provided on the housing as inlets and outlets for the tractive member to be conveyed toward the interior of the housing.

13. The housing according to claim 12, wherein the guide regions are arranged and configured for guiding the tractive member such that the tractive member is pretensioned radially inwardly in the direction of the bearing point.

14. The housing according to claim 12 or 13, wherein the guide regions define two guide channels, of which one serves as an inlet for the tractive member and the other as an outlet for the tractive member and which in relation to the bearing point enclose an angle of less than 180°.

15. The housing according to claim 14, wherein the angle enclosed by the guide regions is between 120° and 180°.

16. The housing according to claim 14, wherein the securing element is arranged in a region of the wall of the housing in which the two guide channels defined by the guide regions converge.

17. The housing according to claim 12, wherein the guide regions define two guide channels of which one serves as an inlet for the tractive member and the other as an outlet for the tractive member and which in relation to the bearing point enclose an angle of more than 180°.

18. The housing according to claim 17, wherein the angle enclosed by the guide regions is between 180° and 240°.

19. The housing according to claim 17 or 18, wherein the securing element is arranged in a region of the wall of the housing opposing, substantially in the radial direction, the region of the wall in which the two guide channels defined by the guide regions converge.

20. The housing according to claim 1, wherein the cable drum is mounted on the bearing point of the housing.

21. The housing according to claim 20, wherein the bearing point of the housing is configured as a bearing element which penetrates a bearing aperture of the cable drum.

22. The housing according to claim 20 or 21, wherein the guide means extending on the outer peripheral surface of the cable drum are configured as guide grooves.

23. The housing according to claim 22, wherein the extension of the securing element in the axial direction of the cable drum is greater than the extension of the guide grooves plus the extension of a positive connection element of the bearing point in the axial direction.

24. The housing according to claim 20, wherein the securing element in the axial direction of the cable drum completely covers the opposing guide grooves of the cable drum.

25. The housing according to claim 20, wherein the securing element in the axial direction of the cable drum has a greater extension than the peripheral surface of the cable drum.

26. The housing according to claim 20, wherein the cable drum is encircled by the tractive member.

27. A housing for receiving a cable drum of an adjustment device for a motor vehicle which comprises a peripheral surface with guide means for a tractive member encircling the cable drum, the housing comprising:

a bearing point for rotatably mounting the cable drum;

at least one wall encompassing the cable drum along its peripheral surface when said cable drum is mounted in the housing;

a securing element proximate to the wall of the housing and configured to secure the tractive member extending along the peripheral surface of the cable drum when the cable drum is mounted in the housing;

wherein the securing element is elastically configured and is movable by deformation in a radial direction in relation to the bearing point; and wherein on the wall of the housing further securing regions are arranged projecting from the wall of the housing in the direction of the bearing point.

28. The housing according to claim 27, wherein the further securing regions are arranged on the wall of the housing such that none of the further securing regions opposes the securing element in the radial direction in relation to the bearing point.

29. The housing according to claim 27 or 28, wherein the further securing regions are formed integrally on the wall of the housing.

* * * * *